United States Patent [19]

Pries

[11] 4,003,802

[45] Jan. 18, 1977

[54] COKE GUIDE MACHINE FOR A BATTERY OF COKE OVENS

[75] Inventor: Erich E. Pries, Bochum, Germany

[73] Assignee: Dr. C. Otto & Comp. G.m.b.H., Bochum, Germany

[22] Filed: Feb. 3, 1975

[21] Appl. No.: 546,619

[30] Foreign Application Priority Data

Oct. 9, 1974 Germany ..... 2448043

[52] U.S. Cl. ..... 202/241; 202/248; 202/262; 212/4

[51] Int. Cl.[2] ..... C10B 25/14; C10B 43/04

[58] Field of Search ..... 202/262, 241, 248; 212/4; 248/277; 49/246, 248, 253

[56] References Cited

UNITED STATES PATENTS

| | | | |
|---|---|---|---|
| 1,392,243 | 9/1921 | Bourque | 49/353 X |
| 3,236,552 | 2/1966 | Percifull | 49/249 X |
| 3,436,316 | 4/1969 | Lorrek | 202/262 X |
| 3,470,981 | 10/1969 | Huxley | 248/277 X |
| 3,577,321 | 5/1971 | Schaten | 202/262 X |
| 3,759,475 | 9/1973 | Brown | 248/277 |
| 3,817,840 | 6/1974 | Stender | 202/262 X |
| 3,823,510 | 7/1974 | Panaccione | 49/247 |

FOREIGN PATENTS OR APPLICATIONS

| | | | |
|---|---|---|---|
| 1,295,218 | 11/1972 | United Kingdom | 201/40 |

*Primary Examiner*—Morris O. Wolk
*Assistant Examiner*—Arnold Turk
*Attorney, Agent, or Firm*—Brown, Murray, Flick & Peckham

[57] ABSTRACT

A coke guide machine includes a shuttle car carried by rails on a coke bench for a battery of coke ovens. Movable along the shuttle car is a carriage having two support stations that are rotatable about a common vertical axis. The support stations include scissor arms that form extendible support devices, one of which carries a handling device for a coke oven door and the other carries a device adapted to clean exposed sealing surfaces of an emptied coking chamber. The carriage also supports a coke guide including an extendible section to bridge an open passageway wherein an inspection car moves along the coke bench between the shuttle car and the coke ovens. A door cleaning machine is positioned in a stationary manner on the shuttle car to clean a coke oven door carried to it by the door handling device after 180° rotation by the support station and movement of the carriage along the shuttle car in a manner to concurrently align the opened coking chamber with the device adapted to clean exposed sealing surfaces thereof.

7 Claims, 6 Drawing Figures

COKE GUIDE MACHINE FOR A BATTERY OF COKE OVENS

BACKGROUND OF THE INVENTION

This invention relates to a machine adapted for movement along the coke side of a battery of coke ovens, and more particularly to such a machine which includes a coke guide, a door handling device, a device for cleaning sealing surfaces of the coking chambers and a device for cleaning the sealing surface of a coke oven door after it is removed from a coke oven chamber.

In a battery of coke ovens, when coke is to be pushed from a given coking chamber, the coke guide machine of the present invention facilitates certain necessary and essential operations. When a coking chamber is to be pushed, the initial operation of the coke guide machine is to first extract the oven door which has been unlatched to thereby open the oven chamber. Thereafter, a coke guide is moved into a coke guiding relationship with the exposed oven chamber in readiness for pushing coke therefrom. After the coke pushing operation is completed, the coke guide is moved aside and a cleaning device is moved into a desired relation with the emptied oven chamber to clean the sealing surfaces of the chamber and at the same time a device is put into operation for cleaning the removed coke oven door. At the conclusion of these operations, the door handling device is again operated to replace and latch the coke oven door onto the oven chamber. During all of these operations, there must be an accurately-aligned relationship between the longitudinal axis of the coking chamber and the tracks supporting the movable devices, namely, the door handling device, the chamber cleaning device and the coke guide.

In the event that the various devices are fixedly mounted upon the coke guide machine, then the entire machine would be required to undergo repositioning movement a number of times and the particular devices on the machine would have to be individually aligned with the axis of the oven chamber to carry out the operations described above in a consecutive manner. It is known in the art that various appliances can be so disposed on a coke guide machine so that the operations of the devices can be performed while the coke guide machine remains in the same position. In this known arrangement, the various appliances are suspended on a support or bearing structure which is movable in the same direction as the movement of the coke guide machine. In this way, the coke guide machine is required to be aligned only once with the longitudinal axis of a coking chamber when it is to be pushed. The various appliances can be correctly positioned during the consecutive operations by their appropriate repositioning on the movable support or bearing structure.

In the known forms of a coke guide machine of the type just described, the machine is movable on a coke bench and the machine passes so closely to the buckstays for the coke oven that very little open space is left exposing the coke bench between the coke ovens and the coke guide machine. This is particularly undesirable in light of the present-day trend of designing coke oven chambers that are very large in height. The exposed space at the coke bench is very desirable since an inspection facility is required, usually in the form of a movable ladder or a suspended cage, for adjustment and readjustment of the sealing elements in the upper part of the oven doors. Moreover, it is desirable that the coke guide machine be designed in such a manner that it is possible to move the machine past such inspection facilities while located between the coke guide machine and the coke oven.

SUMMARY OF THE INVENTION

It is an object of the present invention to provide a coke guide machine which is constructed and designed in such a manner that an access space of an adequate width is established and maintained between the coke guide machine and the masonry of the coke ovens, while at the same time providing a coke guide machine at a very reduced cost and constructed at a reduced length.

It is a further object of the present invention to provide a coke guide machine which is designed so that the pushing operations of coke from a coke oven chamber may be carried out simultaneously with the cleaning operation for a coke oven door which has been removed from that oven chamber.

According to the present invention, there is provided in a battery of coke ovens having horizontally, spaced-apart coking chambers with sealing surfaces at door frames defining coke discharge openings which are normally closed by individually removable doors, and wherein a longitudinal coke bench extends along the battery of coke ovens in a direction which is generally normal to the axes of the coke oven chambers and below the coke discharge openings thereof, a coke guide apparatus movable along the coke bench comprising, in combination, a shuttle car positioned into desired stationary locations relative to the spaced-apart coking chambers by movement along the coke bench while spaced outwardly from the coke ovens in a manner to define an open passageway between the coke ovens and the shuttle car, carriage means supported in a suspended manner by the shuttle car for movement therealong in a generally parallel direction to the movement by the shuttle car along the coke bench, a coke guide including an extendible member supported by the carriage means for bridging the open passageway to conduct coke pushed from an oven chamber above the coke bench, door handling means carried by the carriage means for movement therewith along the shuttle car in the same general direction which the shuttle car moves along the coke bench, means adapted to clean the sealing surface of a coke oven chamber while carried by the carriage means and movable therewith along the shuttle car in the same general direction which the shuttle car moves along the coke bench, transport means operative to bridge the open passageway while coupled between the carriage means and the means adapted to clean by displacing the latter in a generally parallel direction with the axes of the coke oven chambers from an inoperative position lying generally within the bounds of the shuttle car into an operative location at a coking chamber for cleaning the sealing surfaces thereof, transport means operative to bridge the open passageway while coupled between the carriage means and the door handling means by displacing the latter in a generally parallel direction with the axes of the coke oven chambers from an inoperative position lying generally within the bounds of the shuttle car into a door transferring position at a door frame of a coking chamber, and door cleaning means mounted in a fixed manner upon the shuttle car for cleaning the removable doors of the coking chambers.

Thus, according to the present invention the door extractor and the means for cleaning sealing surfaces of a coking chamber are moved out of the structure which supports them upon the shuttle car by means of a transport mechanism and in a direction parallel to the longitudinal axis of the coke oven chamber to be serviced from a normal inoperative position into an operative position by an amount such that the open passageway on the coke bench is maintained between the coke ovens and the shuttle car when the shuttle car is not in use. The shuttle car also supports a coke guide which can be extended in a direction toward the coke ovens through the agency of an extendible or pivotal member employed to bridge the open passageway. However, since the rails for the wheels of the coke guide machine must be farther away from the masonry of the coke oven than has been previously the case, then this feature often requires a slight widening of the coke side bench.

In the preferred form of the present invention, the devices employed to position the movable appliances, namely, the door extracting device and the chamber cleaning device, into an operative position are required to bridge a considerable distance and take the form of a scissor device having arms which are extended by a pressure-operated piston and cylinder assembly in a vertical plane to the axes of the oven chambers. When the arms are in their normal position, i.e., with the scissor arms placed together, they occupy a relatively small space and in this normal position, the suspension mechanism and the appliances connected thereto are very close together in a side-by-side relation.

The door cleaning device can, in a known manner, be fixedly mounted on the shuttle car of the coke guide machine in which case a door removed from an oven chamber is carried by a door extractor that is pivotal and adapted for movement together with the door into the door cleaning mechanism by means of the same transporting or moving mechanism.

A very substantial space can be saved by arranging the suspension structures to support the door extracting machine and the chamber cleaning mechanism one beside the other and in a manner such that they are adapted to pivot about the same vertical axis defined by shafts carried by the suspension structures. By providing this form of pivoting movement, the positioning of the door extractor during the removal and replacement of the door is such that the door extractor moves into a position which is opposite to the door cleaning mechanism so that a coke oven door can be introduced therein by movement of the door extractor and, in this position, the extractor is disposed in a position near the coke ovens.

The door extractor and the coke guide are suspended on the carriage structure for movement along the shuttle car so that when the coke guide is in front of a coking chamber to be pushed, then the door extractor is in front of the door cleaning mechanism. By this arrangement of parts, coke pushing and door cleaning operations can proceed simultaneously with a consequent reduction in operating time.

The overall length of the coke guide machine according to the present invention can be substantially reduced over that of known coke guide machines by a design of the machine which provides that the door extractor and the chamber cleaning mechanism pivot through an angle of at least 180° and that the door cleaning mechanism is disposed on that side of the machine which is remote from the coke ovens. The fact that the door extractor and the chamber cleaning mechanism extend into the open passageway when they are pivoted to their out-of-normal position is of a very minor disadvantage.

These features and advantages of the present invention as well as others will be more fully understood when the following description is read in light of the accompanying drawings, in which.

Figure 1:
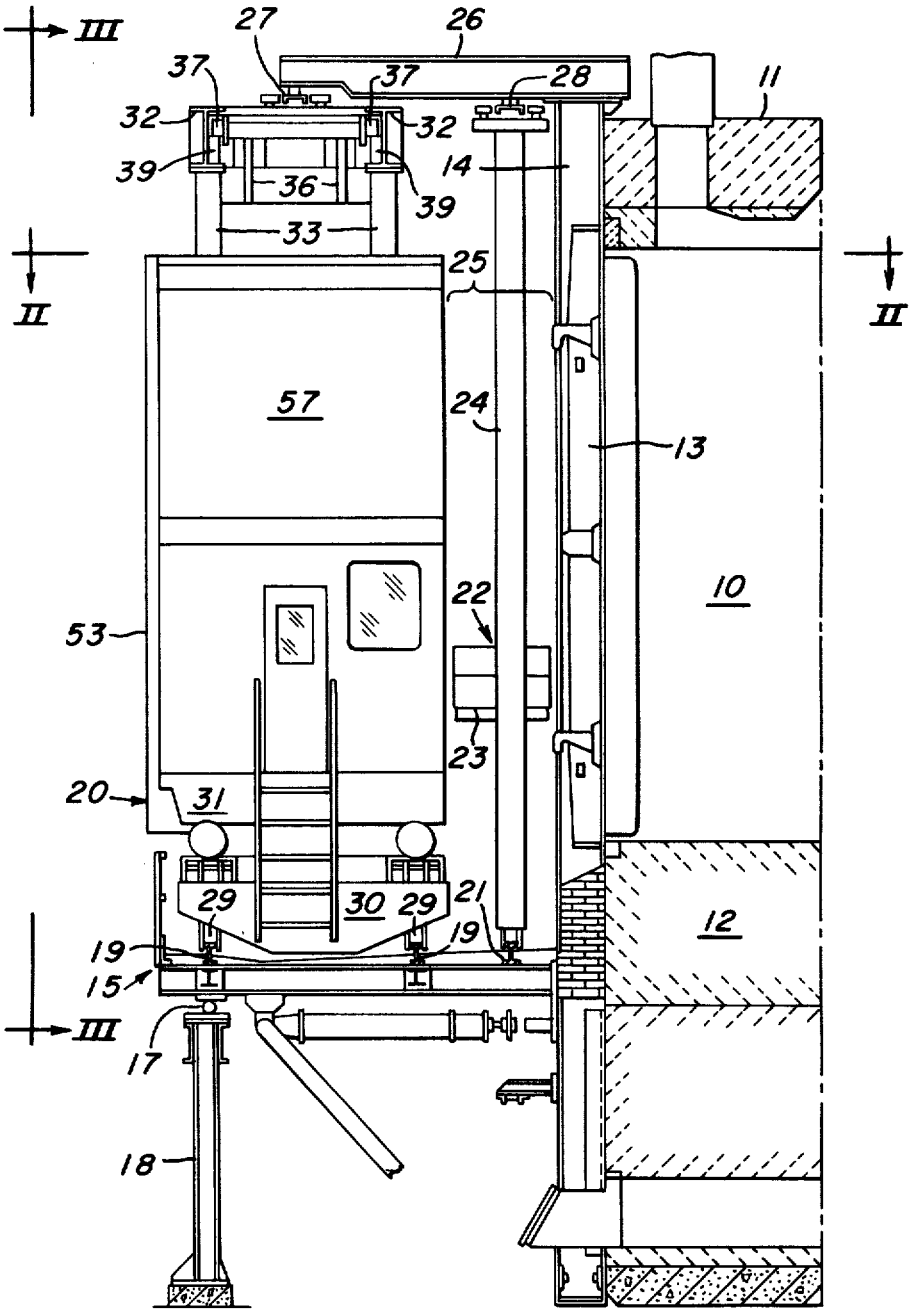
FIG. 1 is an elevational view of a coke bench and a coke guide machine according to the present invention and further illustrating part of a coke oven chamber in cross section.

In FIG. 1, there is illustrated a coke oven chamber 10 forming part of a plurality of spaced-apart and horizontal coking chambers which together define a battery of coke ovens. The coking chamber 10 includes an oven crown 11 at the top thereof and regenerators 12 at the botton thereof. Each oven chamber is normally closed by an individually removable door 13 which must be removed, cleaned and returned to its original position at the conclusion of each coking process. Buckstays 14 brace the masonry forming the battery of coke ovens.

Extending outwardly from the buckstays 14 is a coke bench 15 which is carried by interposed bearing rollers 17 on support members 18. The coke bench extends longitudinally along the coke side of the battery of coke ovens and supports spaced-apart rails 19 for a coke guide machine 20. According to the present invention, the coke bench also supports rails 21 for an inspection station 22 that includes a platform or car 23 carried for vertical movement on a support beam 24 forming part of a lift, hoist or the like. The inspection station provides the agency for access to the top part of the outer wall of the coking chamber at the coke side and specifically the oven doors. In accordance with the present invention, an open passageway 25 is formed between the coke guide machine 20, when it is not in use, and the buckstays 14 for the coke ovens for passage and other essential movements of the inspection station 22. A horizontal support 26 for a coke gas main extends from the buckstays 14 and carries a guide rail 27 for the coke guide machine 20 and a guide rail 28 for the inspection station 22.

Figure 3:
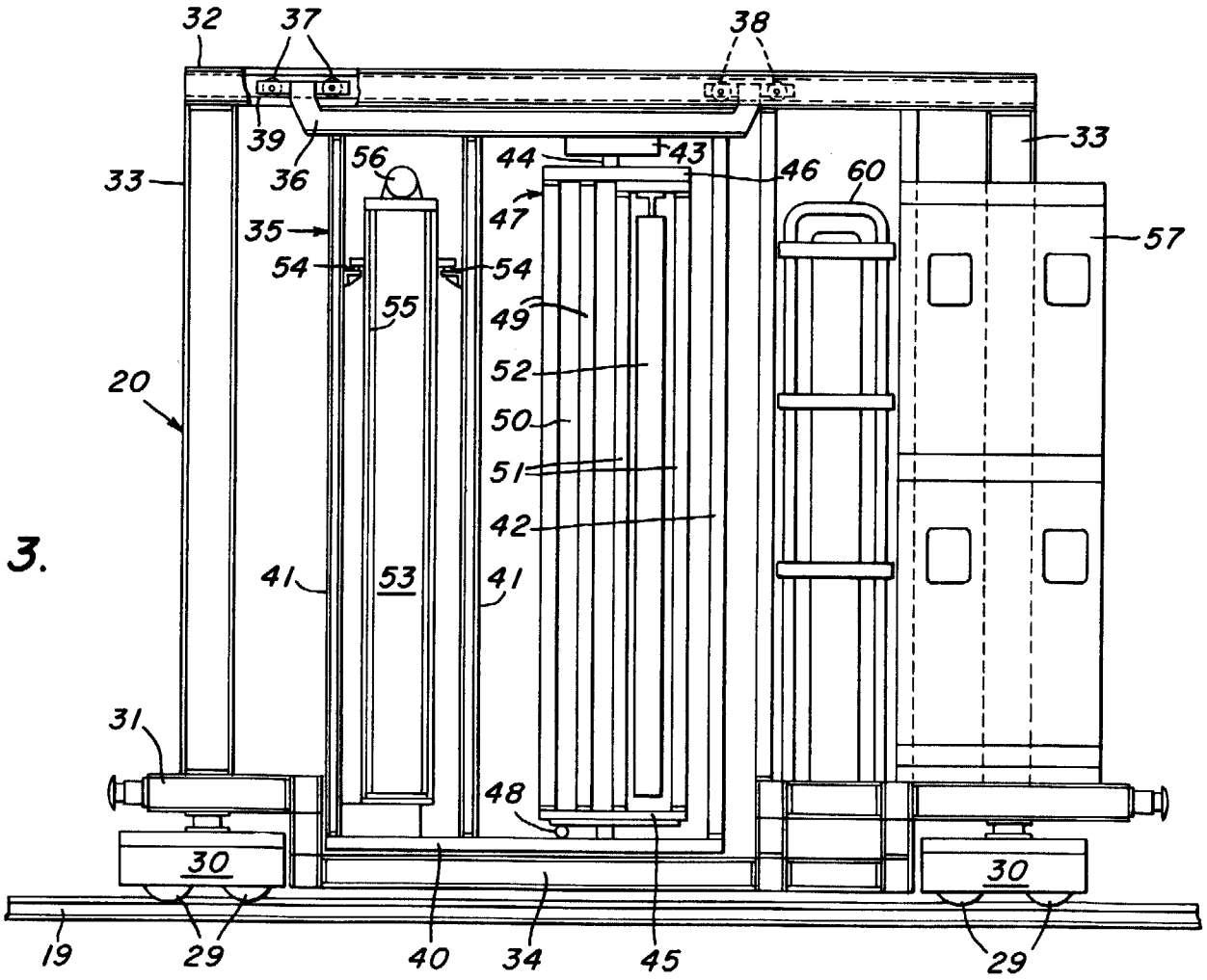
FIG. 3 is a front elevational view taken along line III—III of FIG. 1.

The rails 19 on the coke bench support wheels 29 of trucks 30 whereby the coke guide machine is movable along the coke ovens into desired stationary locations relative to the spaced-apart coking chambers. For this purpose, the trucks 30 actually form part of a shuttle car 31 which further includes, as best illustrated in FIGS. 1 and 3, longitudinal beams 32 that are borne by four columns 33 that extend from a frame 34 of the shuttle car.

A carriage 35 is movable along the shuttle car in the same direction which it moves along the battery of coke ovens. The structure forming the carriage includes horizontal carrier beams 36 provided with a pair of wheels 37 and 38 that runs on tracks 39 that are, in turn, supported by the beams 32 of the shuttle car. The carriage 35 further includes a bottom plate 40 joined with the horizontal carrier beams 36 by vertical crosswalls 41 and 42. The carrier beams 36 support a bearing 43 for a vertical shaft 44. The bottom end of the shaft rests upon the bottom plate 40. A base plate 45 is carried by the shaft 44 which also carries a top plate 46.

The plates 45 and 46 form a carrier-like turntable 47 which can be rotated through an angle of 180° by a drive gear 48 about a vertical axis passing through the shaft 44. The turntable 47 defines two side-by-side support stations including a suspension structure 49 for a door extractor 50. The door extractor is clamped between the plates 45 and 46 on one side of the vertical shaft 44 while on the other side a suspension structure 51 supports a door frame cleaning mechanism 52.

A coke guide 53 is carried by the carriage 35 between the carrier beams 36, the crosswalls 41 and the bottom plate 40. Rollers 54 guide a coke extension member 55 which can be extended by means of a piston and cylinder assembly 56 to bridge the open passageway 25 which, as previously described, is located between the coke guide machine and the coke ovens. The coke guide machine 20 has an operator cab 57 situated at the end thereof opposite the location of the coke guide.

As best shown in FIGS. 2A–2C and 4, an extendible transport mechanism 58 is coupled between the frame cleaner 52 and the suspension structure 51 to support the frame cleaner in an inoperative position lying generally within the bounds of the shuttle car and while extended in a cantilever fashion into an operative location at a coking chamber for cleaning the sealing surfaces thereof. An extendible transport mechanism 59 is coupled between the suspension structure 49 and a door extractor 50 for displacing the latter in a generally parallel direction with the axes of the coke oven chambers from an inoperative position lying generally within the bounds of the shuttle car into a door transferring position at a door frame of the coking chamber and, as will be described in greater detail hereinafter, into the door cleaning device 60 whereby an extracted door 13 can be cleaned. The use of the transport mechanisms 58 and 59 enables the frame cleaner and door extractor to bridge the passageway 25 while supported by the shuttle car but extendible into an operative relation with a given coking chamber in the battery of coke ovens.

Figure 4:
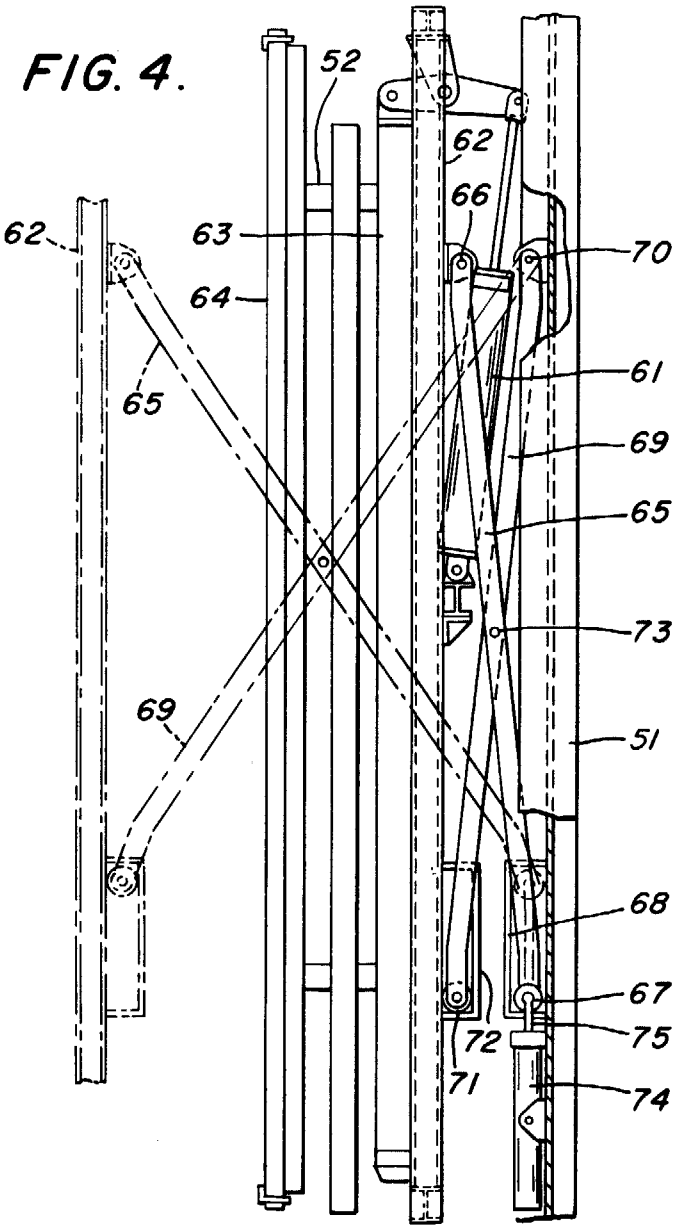
FIG. 4 illustrates the scissor transport arms forming part of a coke guide machine according to the present invention.

FIG. 4 illustrates the details of the construction of the transport mechanism 58 which, as illustrated, carries the frame cleaner 52. It is deemed unnecessary to illustrate the transport mechanism 59 that carries the door extractor 50 since its construction does not materially vary from the transport mechanism 58 illustrated in FIG. 4. In FIG. 4, the solid lines represent the retracted position of the transport mechanism 58 and the phantom-line position represents its extended position. A resilient member 61 includes springs supported by a carrier frame 62 to resiliently suspend a support frame 63 that is also connected to drive means, not shown, for raising and lowering the support frame 63 that, in turn, carries cleaning shavers, scrapers or the like, not shown. A heat shield 64 is carried by the support frame 63. A scissor arm 65 is pivotally mounted on frame 62 by a pivot pin 66 while the other end of arm 65 carries a roller 67 disposed in a roller guide 68 that is, in turn, secured to the suspension structure 51. Scissor arm 69 is pivotally mounted by a pivot pin 70 on crosswall 42. The other end of scissor arm 69 carries a roller 71 disposed in a roller guide frame 72 that is, in turn, supported by the carrier frame 62. The scissor arms 65 and 69 are pivotally interconnected by a pin 73. The suspension structure 51 carries a piston and cylinder assembly 74 having its rod end 75 connected to the roller 67. Thus, it can be readily seen that operation of the piston and cylinder assembly 74 will extend the frame 62 as the piston extends out of the cylinder and in a similar manner the frame 62 is retracted horizontally toward the suspension structure 51 as the piston is retracted within the cylinder.

Figure 2B:
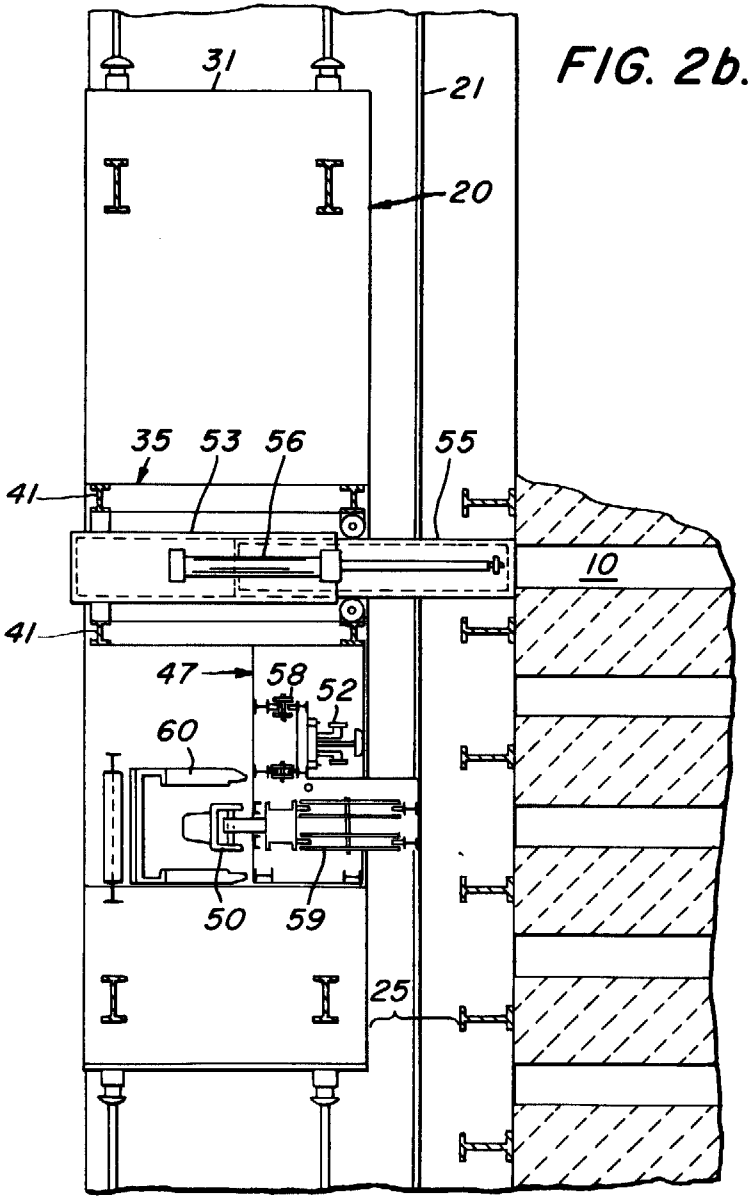
FIGS. 2A–2C are plan views taken along line I—II of FIG. 1 and illustrating the operational sequence of the coke guide machine according to the present invention.
Figure 2A:
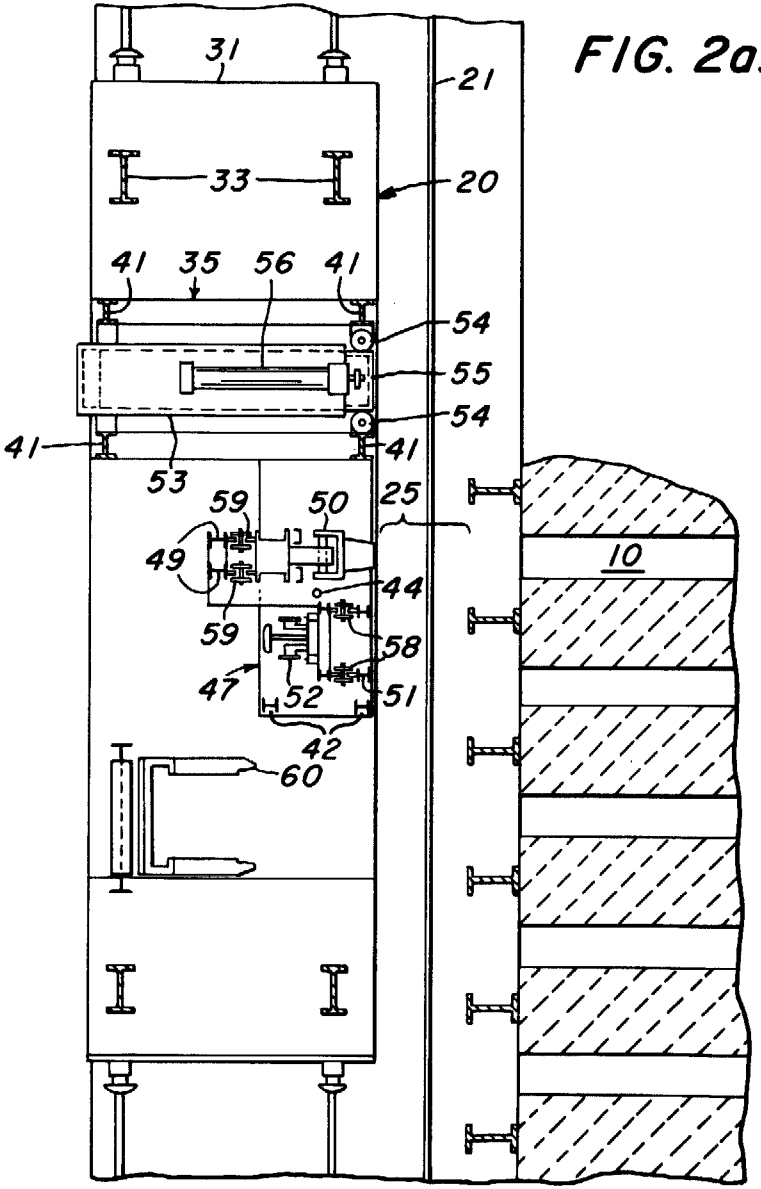

When it is required to push a mass of coke from the oven chamber 10, the coke guide machine 20 is moved along the rails 19 into a predetermined stationary location relative to the coking chamber 10. As previously described, this movement of the coke guide machine occurs along the coke bench while spaced outwardly from the coke ovens in a manner to maintain the open passageway 25. After the coke guide machine has been located in the desired position, the shuttle car 31 remains parked and the longitudinally-movable carriage 35 is positioned relative to the shuttle car as illustrated in FIG. 2A. In this position, the carriage 35 has been moved along the shuttle car in a direction away from the door cleaning device 60. The door extractor 50 is extended by the scissor arms of the transport mechanism 59 and the unlatched door of the coke oven chamber is retracted back into the position shown in FIG. 2A whereby the door as well as the extractor mechanism lie essentially within the confines of the shuttle car. After this occurs, the turntable assembly is rotated about shaft 44 through an angle of 180°. After this occurs, the movable section 55 of the coke guide is extended toward the coke oven chamber 10 by operation of the piston and cylinder assembly 56. At the same time, the scissor arm support provided by the transport mechanism 59 for the door extractor 50 is extended to position the door carried thereby into a desired relationship within the door cleaner 60. As soon as the extendible section 55 is in a proper coke guiding relationship with the oven chamber, the coke pushing operation proceeds. It is a feature of the present invention that the door extractor and the chamber cleaning device are carried in a side-by-side relationship and pivot together about a vertical axis defined by shaft 44. The pivoting movement of these devices is carried out through the use of the turntable 47 whereby in their pivoted position as shown in FIG. 2B they do extend slightly into the open passageway 25 but nevertheless considerable space is saved which enables the overall length of the coke guide machine to be materially reduced as compared with the length of known coke guide machines.

Figure 2C:
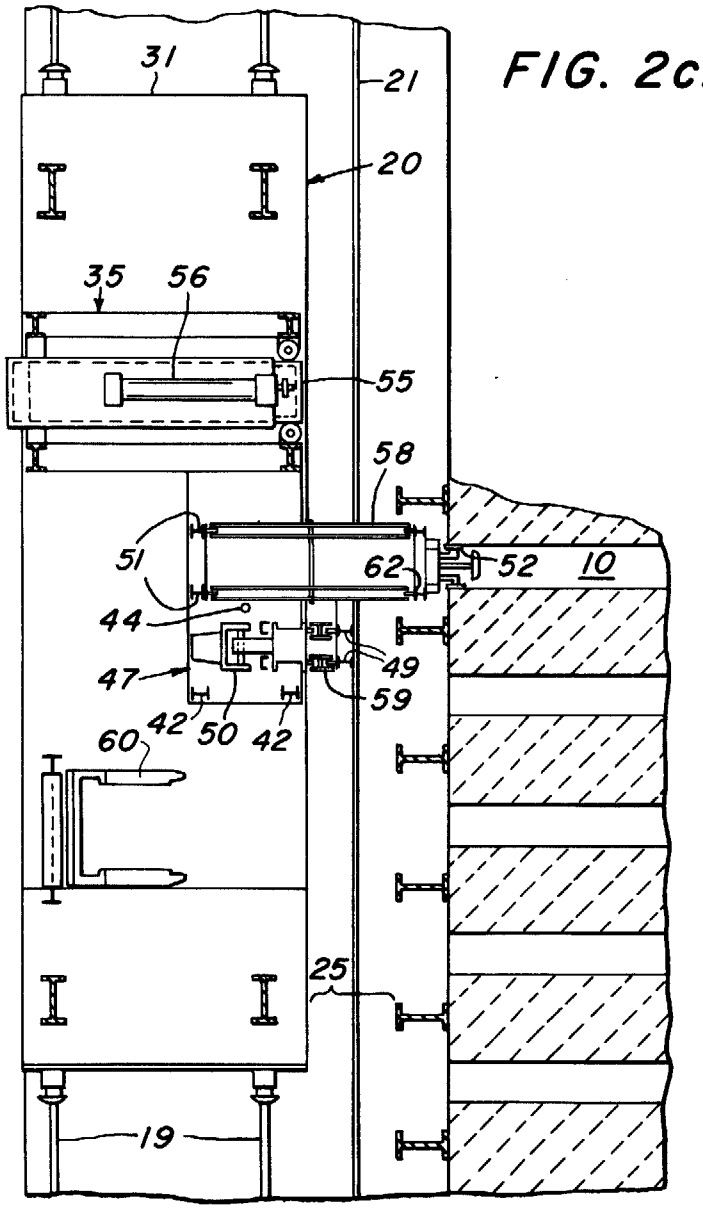

After the coke has been pushed from the oven chamber 10, the extension member 55 is retracted by the reverse operation of the piston and cylinder assembly 56 within the general confines of the shuttle transfer car. Usually by the time that the coke pushing operation has been completed, the door cleaning operation will also have been completed through the use of the cleaner 60 and therefore the cleaned door 13 can be retracted from within the door cleaner. After the extension of the coke guide has been retracted and the door has been removed from the door cleaner, the carriage 35 is moved longitudinally along the shuttle car to the position shown in FIG. 2A. However, in this instance, the turntable 47 remains in its pivoted position which is 180° from that shown in FIG. 2A. In this position, the chamber cleaning device 52 automatically assumes an aligned relationship with the oven chamber whereby the scissor arms of the transport device 58 extend the cleaning device into an operative relation with the oven chamber which is best shown in FIG. 2C. After the sealing surfaces of the oven chambers have been cleaned, the chamber cleaning device is retracted so that it lies generally within the confines of the shuttle car. With the carriage 35 in the same position upon the shuttle car, the turntable 47 is rotated about shaft 44 back into its original position shown in FIG. 2A. After this occurs, the transport device 59 is operated so that the scissor arms thereof extend the door extractor 50 and again bridge the open passageway 25 to position it in a door transferring relation at the door frame. The door is then fitted and latched to the door frame. The door extractor 50 is then retracted back into its inoperative position within the confines of the shuttle car.

Thus, it can be seen that the various operations incident to the pushing of an oven chamber are carried out by moving the carriage 35 only within two different positions. Once the cleaned door has been returned to the door frame, the open passageway 25 has again been restored between the buckstays 14 and the now-inoperative coke guide mechanism 20 so that it can move along the coke bench into a desired position relative to the next oven chamber which is to be pushed.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. In a battery of coke ovens wherein horizontally spaced-apart coking chambers have sealing surfaces at door frames defining coke discharge openings which are normally closed by individually removable doors, and wherein a longitudinal coke bench extends along the battery of coke ovens in a direction which is generally normal to the axes of the coke oven chambers and below the coke discharge openings thereof, a coke guide apparatus movable along said coke bench comprising, in combination:

a shuttle car adapted for positioning into desired stationary locations relative to the spaced-apart coking chambers by movements along said coke bench while spaced outwardly from the coke ovens in a manner to define an open passageway between the coke ovens and the shuttle car, carriage means supported in a suspended manner by said shuttle car for movement along the shuttle car in a generally parallel direction to the movement by the shuttle car along said coke bench, a coke guide including an extendible guide member supported by said carriage means for bridging said open passageway to conduct coke pushed from an oven chamber above said coke bench, door handling means carried by said carriage means for movement therewith along said shuttle car in the same general direction which the shuttle car moves along the coke bench, means adapted to clean the sealing surface of a coking chamber while said means is carried by said carriage means and movable therewith along the shuttle car in the same general direction which the shuttle car moves along the coke bench, first transport means operative to bridge said open passageway while extending between said carriage means and said means adapted to clean the sealing surface by displacing the latter in a generally parallel direction with said axes of the coke oven chambers from an inoperative position lying generally within the bounds of said shuttle car into an operative location at a coking chamber for cleaning the sealing surface thereof, second transport means operative to bridge said open passageway while extending between said carriage means and said door handling means by displacing the latter in a generally parallel direction with said axes of the coke oven chambers from an inoperative position lying generally within the bounds of said shuttle car into a door transferring position at a door frame of a coking chamber, door cleaning means mounted in a fixed manner upon said shuttle car for cleaning said removable doors, and spaced-apart suspension members supported by said carriage means for side-by-side support of said first and second transport means, said suspension members supporting said door handling means and said means adapted to clean the sealing surface, said suspension members being adapted to pivot about a common vertical axis through an angle of 180° relative to said shuttle car to pivotally displace said door handling means from a position defining an aligned relation with a coke oven chamber for movement into a door transferring position therewith into a position where movement of only said carriage means defines an aligned relation with said door cleaning means, said means adapted to clean the sealing surface being pivotally displaced by the suspension members from an inoperative position into a position defining an aligned relation with a coking chamber to clean the sealing surface thereof, said coke guide and said door handling means being supported by said carriage means in a spaced-apart and side-by-side relation for movement along said shuttle car in relation to the fixed location of said door cleaning means on said shuttle car such that when the coke guide is operatively positioned along the shuttle car to receive coke pushed from an oven chamber then concurrently the door handling means is positioned in front of said door cleaning means.

2. The apparatus according to claim 1 wherein said means adapted to clean the sealing surface and said door handling means are extendible by said first and second transport means from opposed sides of said spaced-apart suspension members.

3. The apparatus according to claim 1 wherein said suspension members define two side-by-side support stations for separate support of said means adapted to clean the sealing surface and said door handling means, a support plate secured to said suspension members at the opposite ends thereof, a pivot shaft projecting from each support plate, a carriage frame suspended from said shuttle car for rotatably supporting the pivot shafts, and drive means for rotating the support plates about a common vertical axis to displace said support stations through an angle of 180°.

4. The apparatus according to claim 1 further comprising an inspection station means movable along said coke bench within said open passageway between the coke ovens and the shuttle car.

5. The apparatus according to claim 4 further comprising a track carried on said coke bench for supporting said inspection station means to move along the coke bench adjacent said coking chambers.

6. The apparatus according to claim 1 wherein each of said transport means includes pivotally interconnected scissor arms extending within a vertical plane which is parallel to the longitudinal axis of the coke oven chambers, the scissor arms of each transport means being supported by said suspension members.

7. The apparatus according to claim 6 wherein each of said transport means further includes a fluid-actuated piston and cylinder assembly supported by said suspension members for extending the scissor arms.

* * * * *